US010767435B2

(12) United States Patent
Lugo et al.

(10) Patent No.: US 10,767,435 B2
(45) Date of Patent: Sep. 8, 2020

(54) SLIP HANGER ASSEMBLY

(71) Applicant: GE Oil & Gas Pressure Control LP, Houston, TX (US)

(72) Inventors: Rodolfo Lugo, Houston, TX (US); Andrew Helvenston, Houston, TX (US); Gajanan Hegde, Houston, TX (US); Satish Ramasheshaiah, Houston, TX (US); Eugene Borak, Houston, TX (US); Chijie Lin, Houston, TX (US); Jean Brunjes, Houston, TX (US)

(73) Assignee: GE OIL & GAS PRESSURE CONTROL LP, Houston, TX (US)

( * ) Notice: Subject to any disclaimer, the term of this patent is extended or adjusted under 35 U.S.C. 154(b) by 113 days.

(21) Appl. No.: 16/038,834

(22) Filed: Jul. 18, 2018

(65) Prior Publication Data

US 2019/0024472 A1 Jan. 24, 2019

Related U.S. Application Data

(60) Provisional application No. 62/534,044, filed on Jul. 18, 2017.

(51) Int. Cl.
*E21B 33/04* (2006.01)
*E21B 19/10* (2006.01)

(52) U.S. Cl.
CPC ..... *E21B 33/0422* (2013.01); *E21B 19/10* (2013.01)

(58) Field of Classification Search
CPC .... E21B 19/10; E21B 33/0422; E21B 33/043; E21B 33/05; E21B 33/10; E21B 33/0415; E21B 33/04
See application file for complete search history.

(56) References Cited

U.S. PATENT DOCUMENTS 4,790,379 A * 12/1988 Vanderford, Jr. ... E21B 33/0422 166/208
4,982,795 A * 1/1991 King ..... E21B 33/0422 166/382
5,222,555 A 6/1993 Bridges
(Continued)

FOREIGN PATENT DOCUMENTS

GB 2314867 1/1998
WO 2015/152888 10/2015

OTHER PUBLICATIONS

FMC Technologies, "Casing Hangers," http://www.fmctechnologies.com/en/SurfaceWellhead/Technologies/ConventionalWellhead/CasingHangers.aspx.

*Primary Examiner* — David Carroll
(74) *Attorney, Agent, or Firm* — Hogan Lovells US LLP

(57) ABSTRACT

Embodiments of the present disclosure include a system for installing a slip hanger assembly in a wellbore with a slip bowl comprising an aperture extending from an outer diameter of the slip bowl. The system also includes a slip coupled to the slip bowl, the slip comprising teeth on an inner face and a slot for receiving a shear pin extending through the aperture. The system further includes a running tool coupled to the slip bowl. The system includes a housing coupled to the running tool, the housing including a cylinder for receiving a reciprocating piston, the piston being movable between a first position and a second position, wherein the slip is in stored position while the piston is in the first position and an engaged position when the piston is in the second position.

20 Claims, 18 Drawing Sheets

(56) References Cited

U.S. PATENT DOCUMENTS

| | | | | |
|---|---|---|---|---|
| 5,287,922 | A | 2/1994 | Bridges | |
| 6,095,242 | A | 8/2000 | Lequang et al. | |
| 6,595,297 | B2 | 7/2003 | Dallas | |
| 6,644,401 | B1 * | 11/2003 | Miller | E21B 33/0422 166/75.14 |
| 2009/0260797 | A1 * | 10/2009 | Doud | E21B 19/10 166/53 |
| 2012/0012341 | A1 * | 1/2012 | White | E21B 33/03 166/386 |
| 2017/0009547 | A1 | 1/2017 | Helvenston et al. | |
| 2017/0183922 | A1 * | 6/2017 | Nguyen | E21B 17/12 |

* cited by examiner

SLIP HANGER ASSEMBLY

CROSS-REFERENCE TO RELATED APPLICATIONS

This application claims benefit of U.S. Provisional Application No. 62/534,044 filed Jul. 18, 2017, entitled "SLIP HANGER ASSEMBLY SYSTEM AND METHOD," which is incorporated by reference in its entirety.

BACKGROUND

1. Field of Invention

This disclosure relates in general to wellhead assemblies, and in particular, to a hanger for supporting a tubular member within a wellhead assembly.

2. Description of the Prior Art

When drilling and completing subterranean wells, such as wells used for hydrocarbon production, successive joints of tubular members are run into the well through a wellhead. The successive joints of tubular members can be connected together with collars. Collars generally have a larger outer diameter than the outer diameter of the tubular members. There can be times when the tubular members become stuck and cannot move upwards or downwards. In such a situation, the tubular member may not be able to be supported by the wellhead by the planned or existing support mechanism and a backup or emergency support for the tubular member is installed.

Current methods for providing such backup or emergency support can include cutting off the tubular member within the outer well member and installing slips over an end of the tubular member that can land on a support shoulder in the outer well member and grip the tubular member. After cutting the tubular member, the tubular member can remain suspended within the outer well member without being secured or supported, providing a possibility of the tubular member falling within the outer well member and causing potential damage to the well, creating a possible safety and environmental risk, and requiring time and money to retrieve the fallen tubular member.

If the tubular member is not cut, a collar may be located along the tubular member above the support shoulder. The slips used in this instance will have a sufficiently large inner diameter to pass by such a collar and still be able to grip the tubular member having a smaller outer diameter. Some current slip hangers used to pass over a collar are expandable. However when the expandable slip hanger and slips contract to grip the tubular member, there is a gap between the outer diameter of the slip hanger and the inner diameter of the outer well member. As such, the slip hanger can move radially outward and the slips can potentially lose their grip on the tubular member.

SUMMARY

Applicant recognized the problems noted above herein and conceived and developed embodiments of systems and methods, according to the present disclosure, for slip hanger assemblies.

In an embodiment, a system for installing a slip hanger assembly in a wellbore includes a slip bowl comprising a stepped inner profile and an aperture extending from an outer diameter of the slip bowl to the stepped inner profile.

The system also includes a slip coupled to the slip bowl, the slip having a mating external profile and being arranged against the stepped inner profile, the slip further comprising teeth on an inner face and a slot for receiving a shear pin extending through the aperture. The system further includes a running tool coupled to the slip bowl. The system includes a housing coupled to the running tool, the housing including a cylinder for receiving a reciprocating piston, the piston being movable between a first position and a second position, wherein the slip is in stored position while the piston is in the first position and an engaged position when the piston is in the second position.

In an embodiment, a system for installing a downhole tool onto a wellbore tubular includes a winch arranged at a surface location, the winch including a cable controllable via movement of the winch. The system also includes a blow out preventer coupled to a wellbore and a slip hanger assembly. The slip hanger assembly is coupled to the winch via the cable and installed through the blow out preventer and includes a housing, the housing having a cylinder that contains a piston. The slip hanger assembly also includes a running tool coupled to the housing. The slip hanger assembly further includes a slip bowl coupled to the running tool via a releasable coupling, wherein activation of the piston at a first predetermined force releases the running tool from the slip bowl. The slip hanger assembly includes a plurality of slips arranged within and releasably coupled to the slip bowl, wherein activation of the piston at a second predetermined force releases the plurality of slips from the slip bowl to engage the wellbore tubular at an outer diameter of the wellbore tubular.

In a further embodiment, a method for installing a downhole tool into a wellbore includes releasably coupling a slip to a slip bowl, the slip bowl being arranged on a slip hanger assembly including a piston arrangement for releasing the slips from the slip bowl at a first predetermined force and for releasing the slip bowl from the slip hanger assembly at a second predetermined force. The method also includes coupling the slip hanger assembly to a surface conveyance system, the surface conveyance system controlling a descent rate of the slip hanger assembly into the wellbore. The method further includes positioning the slip hanger assembly into the wellbore through a blow out preventer arranged at a surface location. The method also includes landing the slip hanger assembly onto a wellbore tubular. The method includes activating the piston arrangement at the first predetermined force to release the slip from the slip bowl, the slip biting into an outer diameter of the wellbore tubular via teeth. The method also includes activating the piston arrangement at the second predetermined force to release the slip bowl from the slip hanger assembly. The method includes removing the slip hanger assembly from the wellbore while the slip bowl remains coupled to the wellbore tubular via the slips.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
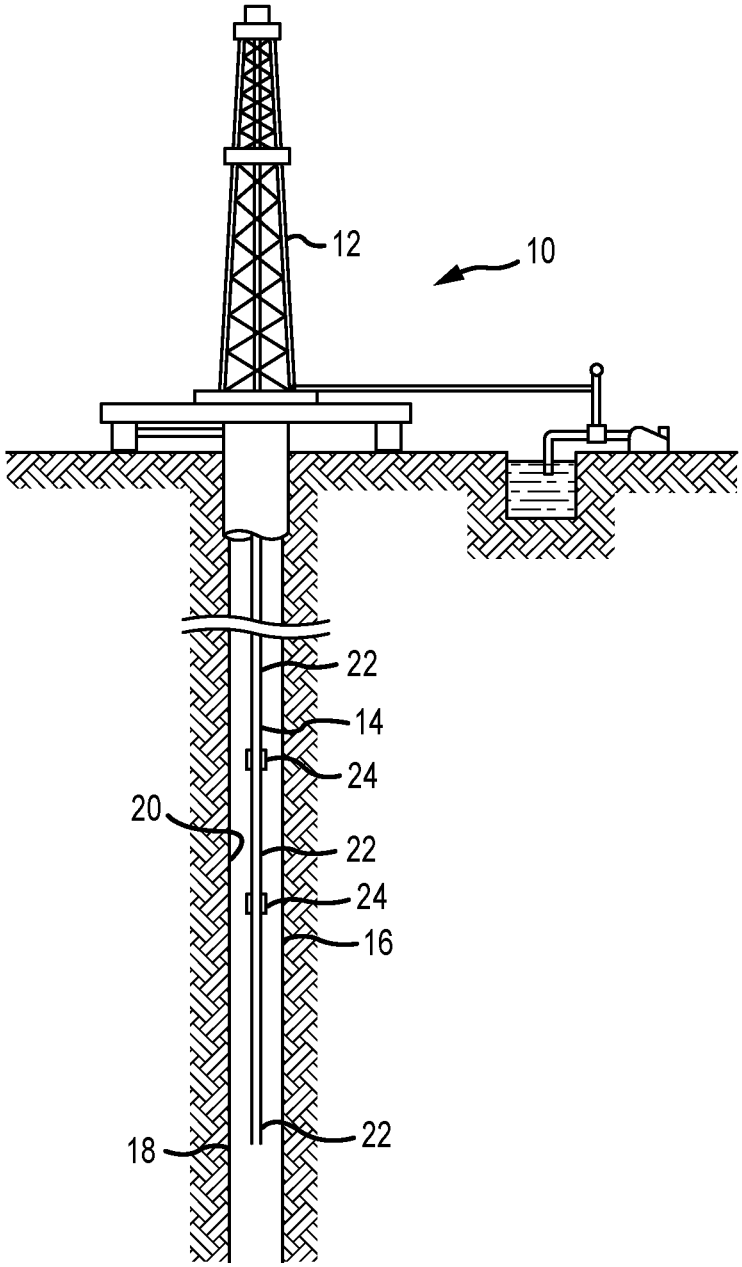
FIG. 1 is a schematic cross-sectional view of an embodiment of a drilling system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include a slip hanger assembly that may be installed through a blow out preventer (BOP) while including an inner diameter that is larger than an outer diameter of a collar, thereby enabling installation of the slip hanger assembly over a collar coupling two tubular segments together. In various embodiments, the slip hanger assembly includes a housing having an annular piston arranged therein, the annular piston driving slips stored in a slip bowl from a stored position to an engaged position. In the engaged position, the slips grip a tubular segment, such as a casing segment or production tubing, and secure the slip bowl to the tubular segment. As a result, additional downhole tools may be lowered into the wellbore and landed on the slip bowl, which enables continued downhole operations. In various embodiments, the slip hanger assembly further includes a running tool coupled between the housing and the slip bowl. In various embodiments, the piston is configured to shear one or more pins coupling the running tool to the slip bowl to enable removal of the housing and running tool from the wellbore while the slip bowl remains coupled to the tubular. In various embodiments, different pressures applied by the piston may enable different operations in the downhole environment. For example, at a first pressure, one or more pins coupling the slips to the slip bowl may be sheared to transition the slips between the stored position and the engaged position. At a second pressure, for example, the slips may be further engaged and tested. At a third pressure, one or more pins coupling the running tool to the slip bowl may be sheared. In various embodiments, the first, second, and third pressures are different, with subsequent pressures being greater than previous ones. In operation, the slip hanger assembly may include a conveyance system that enables the slip hanger assembly to be lowered into the wellbore from a surface location. For example, the conveyance system may include one or more pulleys coupled to pulleys of a winch at the surface via a rope, wire, cable, or the like. The slip hanger assembly may be lowered and positioned in the wellbore through the BOP at the surface, which reduces the number of components that are removed at the surface location to install the slip hanger assembly. Accordingly, the slip hanger assembly may be deployed faster and more economically than other methods.

FIG. 1 is a schematic side view of an embodiment of a downhole drilling system 10 (e.g., drilling system) that includes a rig 12 and a production string 14 coupled to the rig 12. In the illustrated embodiment, production string 14 extends into a wellbore 16 having an annulus 18 between a sidewall 20 of the wellbore 16 and the production string 14. While the illustrated wellbore 16 is not cased, it should be appreciated that, in various embodiments, the wellbore 16 may including casing along at least a portion of the wellbore 16.

In various embodiments, the production string 14 is formed from joints or segments 22 of tubulars (e.g., pipe) coupled together. In certain embodiments, the segments 22 may be threaded together or coupled together via one or more collars 24. As described above, in various embodiments the production string 14 may become stuck within the wellbore 16, for example due to reduced diameter portions of the wellbore 16, deviated sections of the wellbore 16, or the like. Various embodiments of the present disclosure describe a slip hanger system for supporting sections of the production string 14 that may be cut or otherwise separated due to being stuck within the wellbore 14. However, it should be appreciated that while various embodiments may be discussed with reference to production strings 14, that systems and methods of the present disclosure may be utilized with any downhole tubulars, such as sections of casing and the like. Furthermore, it should be appreciated that various components of the drilling system 10 have been removed for clarity with the present disclosure. For example, the drilling system 10 may include a blow out preventer (BOP) coupled to a wellhead assembly.

Figure 2:
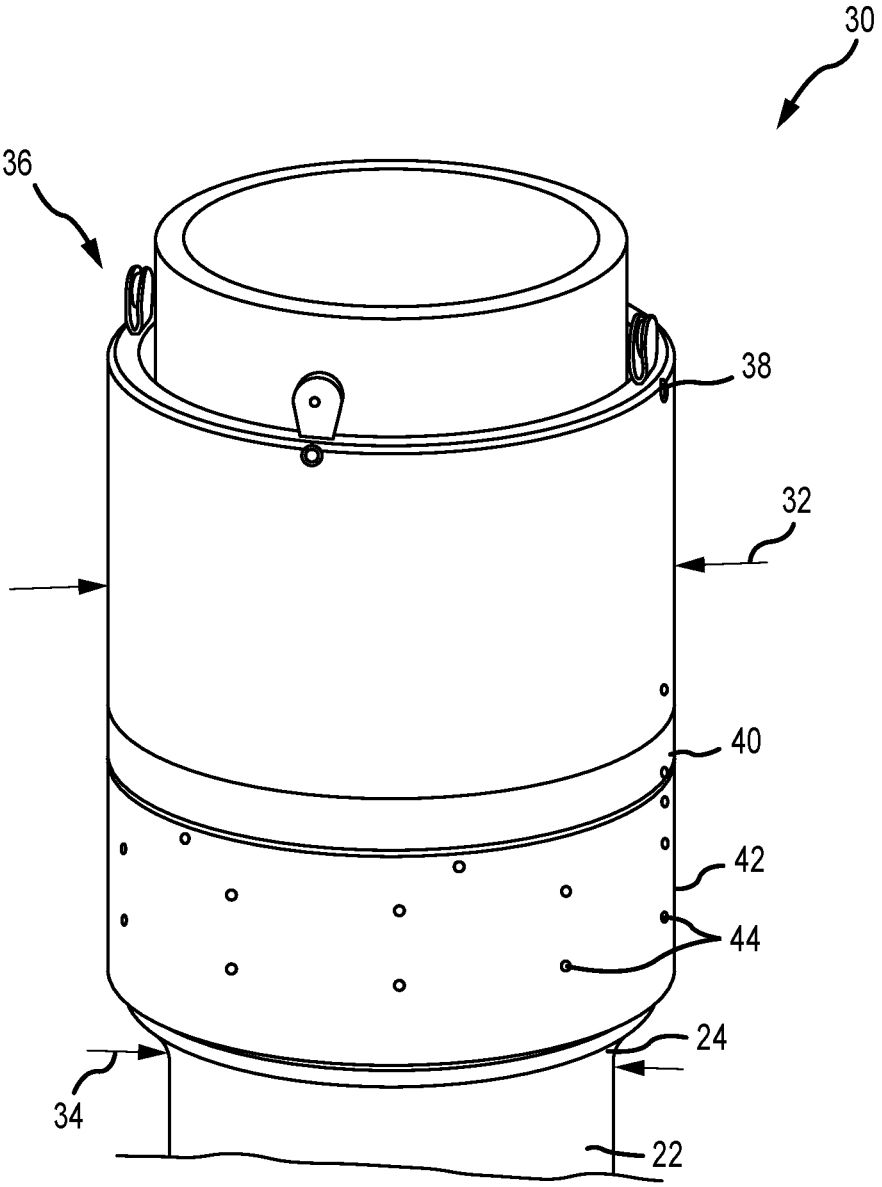
FIG. 2 is a perspective view of an embodiment of a slip hanger assembly, in accordance with embodiments of the present disclosure.

FIG. 2 is a front perspective view of an embodiment of a slip hanger assembly 30 that may be utilized with embodiments of the present disclosure. The illustrated embodiment includes the segment 22 having the collar 24 arranged at an upper end thereof. The slip hanger assembly 30 is arranged over the collar 24. That is, the slip hanger assembly 30 is a larger outer diameter 32 than an outer diameter 34 of the collar 24. In various embodiments, the outer diameter 32 is particularly selected to be smaller than an inner diameter of the BOP and, as a result, the slip hanger assembly 30 may be installed through the BOP, thereby reducing the removal of components at the surface. As will be described below, in various embodiments one or more conveyance systems 36, such as the illustrated pulleys, may be used to lower the slip hanger assembly 30 into the wellbore 16.

In the illustrated embodiment, the slip hanger assembly 30 includes a housing 38, a running tool 40, and a slip bowl 42. The housing 38 is positioned at a top of the slip hanger assembly 30 and includes one or more mounting regions for the conveyance system 36. The housing 38 may have a length that is particularly selected based on the applications. For example, it may be desirable to have a longer housing 38 to increase the weight of the slip hanger assembly 30. A heavier slip hanger assembly 30 may be advantageous in maintaining a taught cable or rope as the slip hanger assembly 30 is lowered into the wellbore 16. Furthermore, in various embodiments, the increased weight may provide stability and security as the slip hanger assembly 30 is landed on a load shoulder. In various embodiments, the running tool 40 is arranged axially below the housing 38, followed by the slip bowl 42 axially below the running tool 40 at a bottom of the slip hanger assembly 30. In the illustrated embodiment, the slip bowl 42 includes apertures 44 arranged circumferentially about the annual body of the slip bowl 42. The apertures 44 may receive one or more shear pins, which as will be described below, may be used to set the slip hanger assembly 30 into position to grip the collar 24. In operation, setting slips arranged within the slip bowl 42 may decouple the running tool 40 from the slip bowl 42 and enable removal of the housing 38 and the running tool 40.

Figure 3:
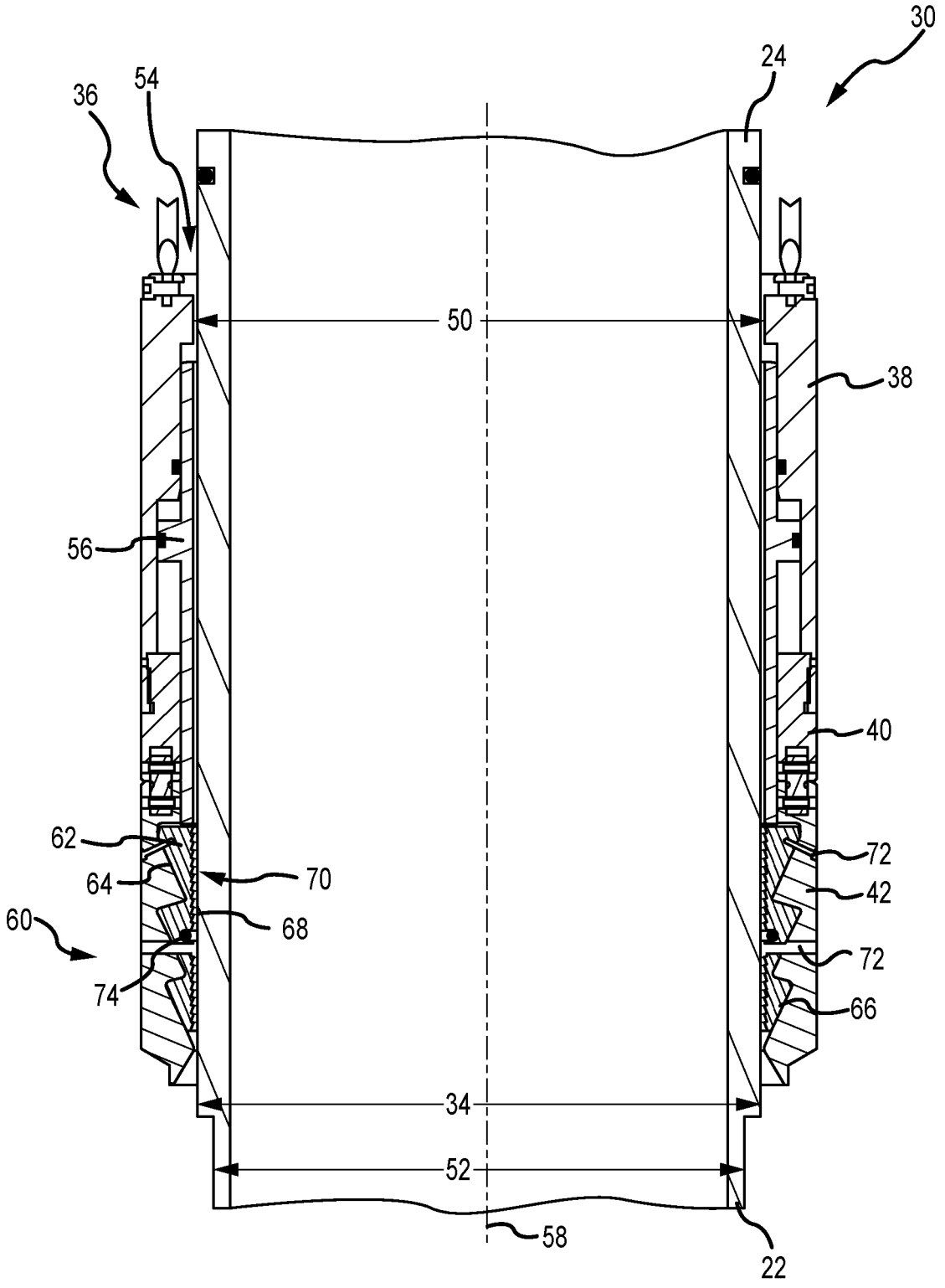
FIG. 3 is a cross-sectional view of the slip hanger assembly of FIG. 1, in accordance with embodiments of the present disclosure.

FIG. 3 is a schematic cross-sectional view of an embodiment of the slip hanger assembly 30 arranged over the collar 24. As described above, the collar 24 is coupled to an outer diameter of the segment 22. In various embodiments, the segment 22 originally coupled to the top of the collar 24 may be cut or removed. In operation, the slip hanger assembly 30 may be lowered into the wellbore 16 via the conveyance system 36 and arranged along the outer diameter 34 of the collar 24. As illustrated, an inner diameter 50 of the slip hanger assembly 30 is larger than the outer diameter 34, thereby enabling the installation of the slip hanger assembly 30.

As shown in FIG. 3, the outer diameter 34 of the collar 24 is larger than an outer diameter 52 of the segment 22. The stepped profile at the transition between the collar 24 and the segment 22 poses a challenge for installation of the slip hanger assembly 30, as the change in diameters 34, 52 may be difficult to seal against. As will be described below, embodiments of the present disclosure enable installation of the slip hanger assembly 30, even with the stepped profile. Furthermore, in various embodiments, the slip hanger assembly 30 is sized such that installation is performed without removing several components at the surface, for example, without removing the BOP.

The illustrated conveyance system 36 includes pulleys coupled to a top of the housing 38. In various embodiments, the conveyance system 36 may further include ropes or cables to control a descent rate of the slip hanger assembly 30. For example, as will be described below, in various embodiments a winch may be arranged at the surface to gradually lower the slip hanger assembly 30 into the wellbore 16. In the illustrated embodiment, the conveyance system 36 is coupled to the housing 38 via pins or fasteners, but it should be appreciated that other coupling means may be used, such as adhesives, clips, and the like.

The illustrated embodiment further includes ports 54 that may introduce a fluid to drive an annular piston 56 arranged radially inward from the housing 38. That is, the piston 56 is radially closer to a longitudinal axis 58 of the slip hanger assembly 30. The piston 56 extends along the axis 58 such that the piston 56 extends beyond the housing 38 toward a bottom 60 of the slip hanger assembly 30. In the illustrated embodiment, the piston 56 is radially inward of the running tool 40 and further extends towards slips 62 arranged within the slip bowl 42. As will be described below, in operation the piston 56 is activated, for example by hydraulic pressure, to shear one or more shear pins to transfer the slips 62 from the illustrated stored position to a deployed position (not shown). In various embodiments, one or more seals may be positioned to regulate operation of the piston and maintain substantially fluid tight barriers between different portions of the slip hanger assembly. Furthermore, in various embodiments, the piston 56 may also shear one or more pins coupling the running tool 40 to the slip bowl 42.

In various embodiments, the running tool 40 is coupled to the housing 38 and, in various embodiments, at least a portion of its outer diameter is substantially equal to an outer diameter of the housing 38. As illustrated, the running tool 40 is further coupled to the slip bowl 42, for example via one or more pins or couplings. In operation, movement of the piston 56 to a predetermined position or with a predetermined force/pressure may shear the pins couplings to disengage the slip bowl 42 from the running tool 40, which allows the running tool 40 to be removed from the wellbore 16 along with the housing 38. The pins may be arranged circumferentially about the slip hanger assembly 30. For example, there may be six total shear pins, or three pairs of two. It should be appreciated that any number of shear pins may be used. The shear pins may have a capacity of approximately 8000 pounds each The embodiment illustrated in FIG. 3 further illustrates the slip bowl 42 which includes radially inward slips 62. In operation, the slips 62 are driven from the illustrated stored position to a deployed position to engage the collar 24 and/or segment 22. The slip bowl 42 includes a profile 64 that substantially matches a profile 66 of the slips 62. The profile 64 facilitates driving the slips 62 radially inwardly against the collar 24 to secure the slips 62 to the collar 24 and/or segment 22. The slips 62 may be arranged within the slip bowl 42 and include a set of teeth 68 on an inner face 70 closest to the collar 24. The inner face 70 may be opposite the profile 66. In certain embodiments, there may be slips 62 arranged circumferentially about the slip hanger assembly 30. For example, there may be ten total slips 62.

In various embodiments, the slip bowl 42 includes one or more apertures 72 extending toward the slips 62. The apertures 72 may receive pins that, upon activation of the piston 56 to a predetermined location, may shear to release the slips 62 from the slip bowl 42. In certain embodiments, the pins have a capacity of approximately 900 pounds. As the piston 56 is activated, the piston 56 moves in a downward direction toward the slip 62 and drives the slip 62 downward to shear the shear pin and move the slip 62 to the engaged position (not pictured). Accordingly, the slips 62 may move into engagement with the smaller diameter tubular 22 and/or collar 24 to grip the tubular 22 and/or collar 24. The illustrated slip 62 also includes a snap ring 74 positioned on the rear end by the teeth 68. The snap ring 74 is utilized to control the activation of the slips 62 such that each slip 62 activates at approximately the same time, thereby securely engaging the tubular 22 without tilt or sway.

Figure 4:
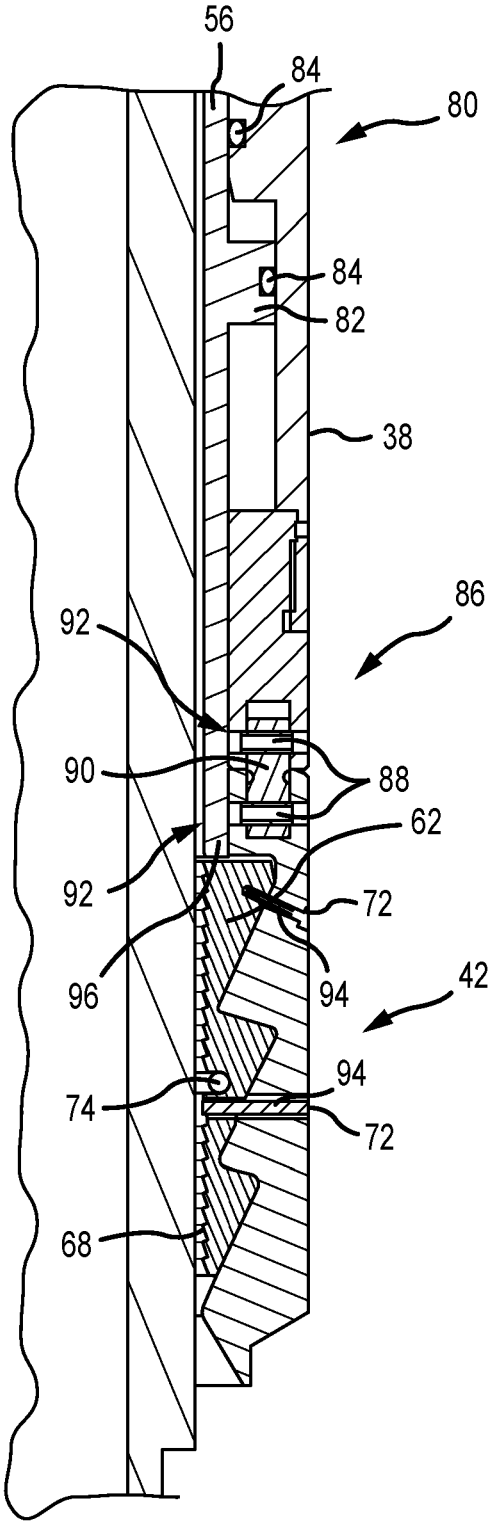
FIG. 4 is a detailed cross-sectional view of the slip hanger assembly of FIG. 1, in accordance with embodiments of the present disclosure.

FIG. 4 is a detailed cross-sectional view of an embodiment of the piston 56 arranged proximate the slips 62 in the slip bowl 42. The illustrated slips 62 are in the stored position because the piston 56 has not been activated. Furthermore, the above described stepped profile between the collar 24 and the segment 22 is illustrated in FIG. 4. As will be illustrated herein, movement of the slips 62 may extend beyond the collar 24 to engage the segment 22.

The illustrated piston 56 is arranged within a cylinder 80 and includes an extension 82 extending radially outward from the axis 58. The extension includes a seal 84 that bears against a wall of the cylinder 80 to block fluid passage between the extension 82 and the cylinder wall, thereby driving movement of the piston 56. Furthermore, a second seal 84 is arranged uphole from the extension 82 and uphole of the cylinder 80. It should be appreciated that a variety of seals may be utilized with embodiments of the present disclosure to provide particularly selected fluid isolation for driving movement of the piston 56.

The embodiment further illustrates a coupling 86 including pins 88 between the running tool 40 and the slip bowl 42. The coupling includes a block 90 having openings 92 for receiving the pins 88. In operation, movement of the piston 56 drives the running tool 40 downward and against the block 90. The block 90 then applies pressure to the pins 88, shearing the pins to enable removal of the running tool 40 while the slip bowl 42 remains within the wellbore 16.

FIG. 4 also illustrates a shear pin 94 extending through the aperture 72 to secure the slip 62 to the slip bowl 42. Moreover, the snap ring 74 is illustrated on the inner face proximate the teeth 68. As described above, in operation a lower portion 96 of the piston 56 applies a force to the slip 62, which shears the shear pin 94 and drives the slip 62 in a downward direction to engage the segment 22.

Figure 5:
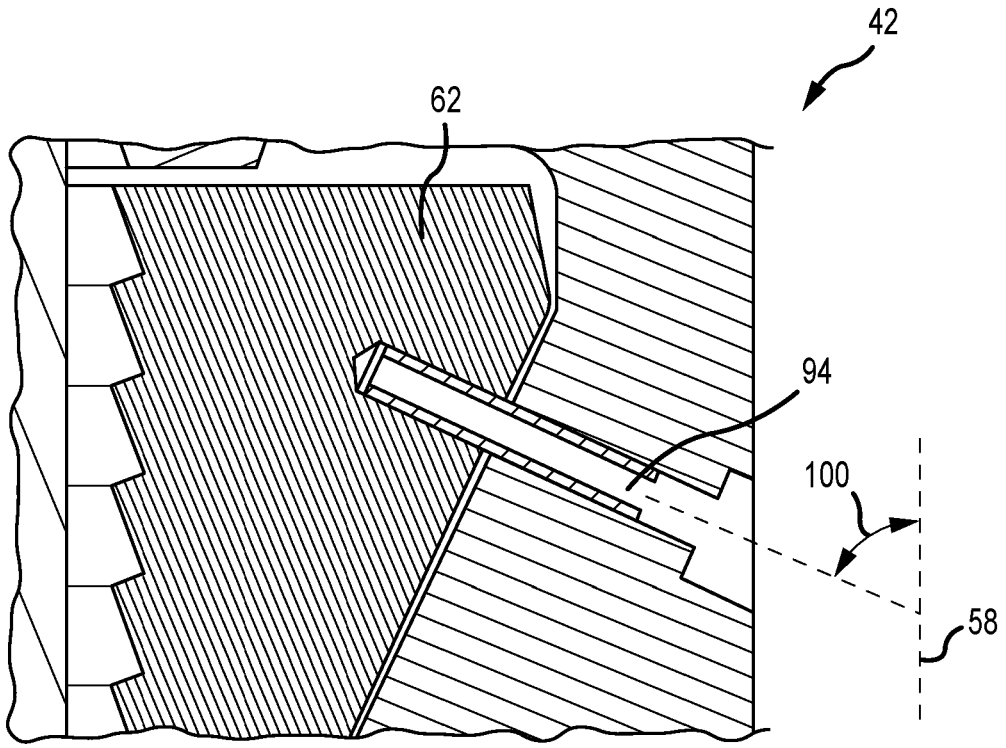
FIG. 5 is a detailed cross-sectional view of a slip of the slip hanger assembly of FIG. 1, in accordance with embodiments of the present disclosure.

FIG. 5 is a detailed cross-sectional view of an embodiment of the shear pin 94 coupling the slip 62 to the slip bowl 42. It should be appreciated that the length of the shear pin 94 is shown for illustrate purposes only, and that in various embodiments, the shear pin 94 may be longer or shorter. Furthermore, a diameter of the shear pin 94 may be particularly selected based on a desired breaking force. In the illustrated embodiment, the shear pin 94 is arranged within the aperture 72 at an angle 100 relative to the axis 58. The angle 100 may be particularly selected to increase or reduce the force used to shear the shear pin 94.

Figure 6:
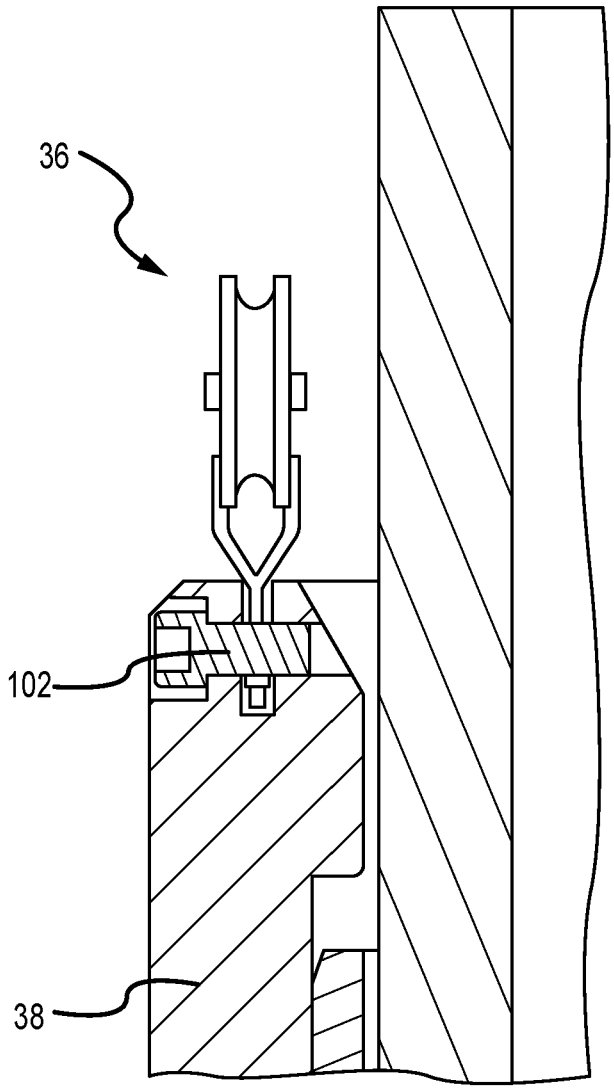
FIG. 6 is a detailed cross-sectional view of a conveyance assembly arranged on the slip hanger assembly of FIG. 1, in accordance with embodiments of the present disclosure.

FIG. 6 is a detailed cross-sectional view of an embodiment of the conveyance system 36 arranged on the housing 38. The illustrated conveyance system 36 is a pulley, which may be referred to as a block pulley. The conveyance system 36 includes a fastener 102, such as a bolt, for coupling to the housing 38. In operation, wire rope or cable is arranged around the sheave of the pulley, which may be free to rotate about an axis, to support the slip hanger assembly 30 as it is lowered into the wellhead. Additionally, the block pulley may be utilized to remove the housing 38 and running tool 40 from the wellbore 16 after the slips 62 are set in the engaged position.

Figure 7:
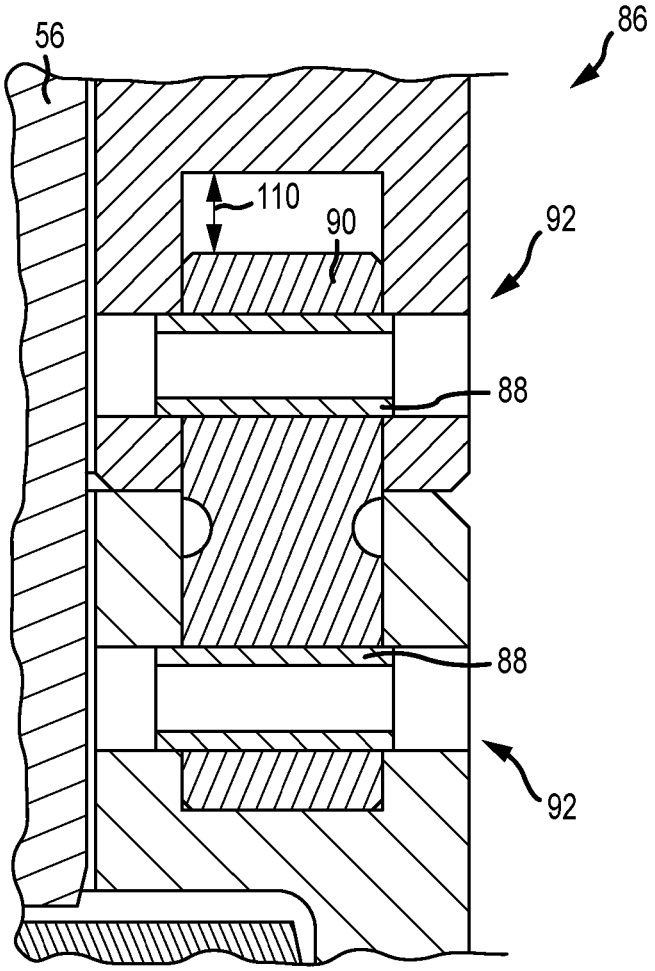
FIG. 7 is a detailed cross-sectional view of an embodiment of a coupling of the slip hanger assembly of FIG. 1, in accordance with embodiments of the present disclosure.

FIG. 7 is a detailed cross-sectional view of an embodiment of the coupling 86 used for connecting the running tool 40 to the slip bowl 42. As described above, in various embodiments the coupling includes pins 88 extending through the running tool 40 and the slip bowl 42. As shown, the pins 88 are separate from one another, however a single pin may be used, for example that is arranged at an angle to extend between both the running tool 40 and the slip bowl 42. The block 90 includes openings 92 for receiving the pins 88. The pins 88 couple the running tool 40 to the slip bowl 42 until the piston 56 is activated and supplies sufficient force to break the pins 88 and decouple the running tool 40 from the slip bowl 42. For example, in various embodiments the running tool 40 may move in the downward direction such that a gap 110 is removed between the running tool and the block 90. Accordingly, the force from the running tool 40, which it receives from the piston 56, is transferred to the block 90 and subsequently the pins 88. It should be appreciated that a length of the pins 88 may be longer than illustrated in FIG. 7. Moreover, the pins 88 may not be the same size.

Figure 8:
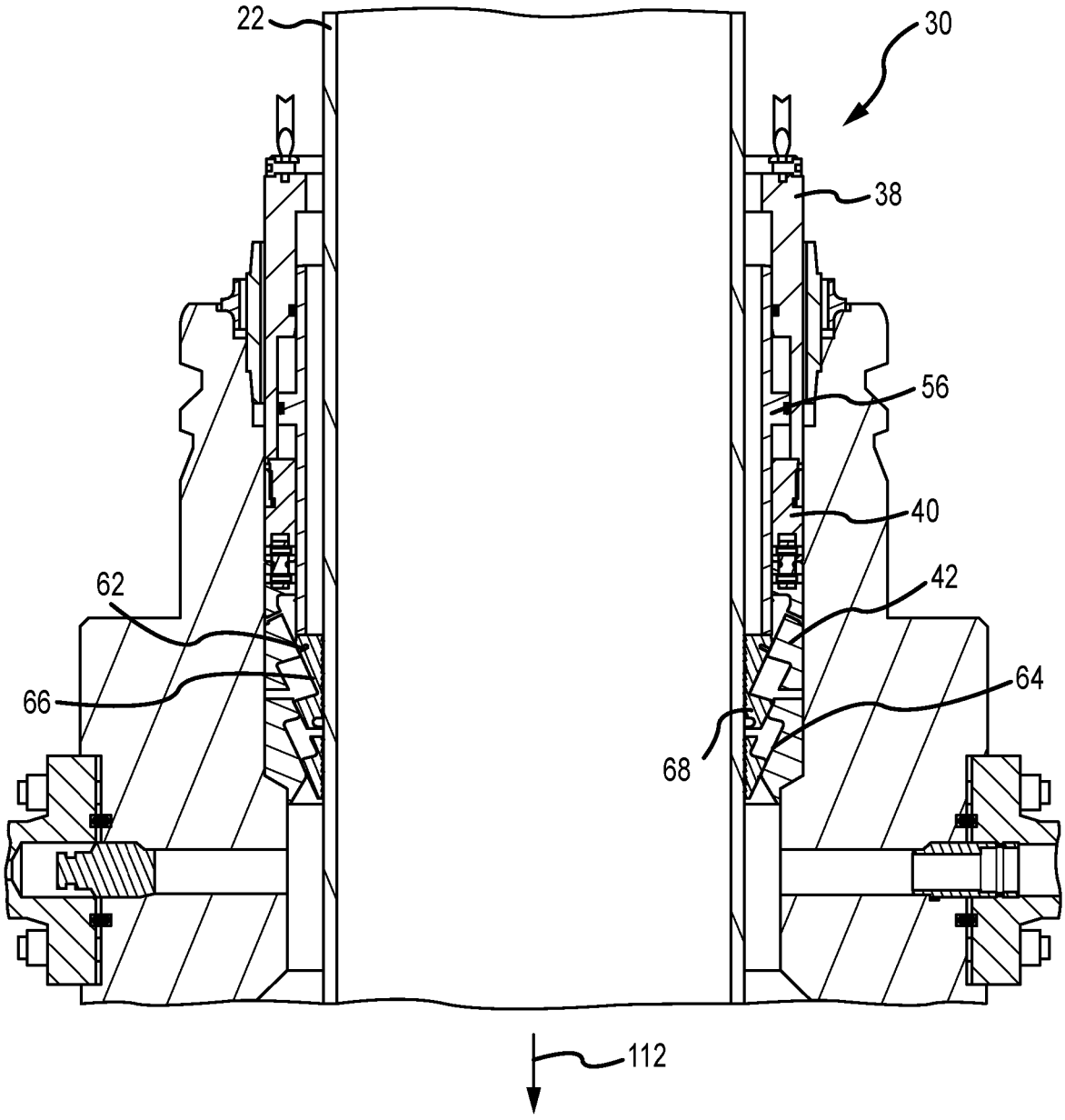
FIG. 8 is a cross-sectional view of a slip hanger assembly, in accordance with embodiments of the present disclosure.

FIG. 8 is a cross-sectional view of an embodiment of the slip hanger assembly 30 coupled to the segment 22 via the slips 62. In the illustrated embodiment, the piston 56 has moved in a downward direction 112 to drive the slips 62 into an engaged position. As shown, the profile 64 of the slip bowl 42 and the profile 66 of the slips 62 are no longer proximate one another as the slips are moved downward and radially inward. In various embodiments, the force supplied by the piston 56 is particularly selected to shear the shear pin 94, but not the pins 88. As a result, different levels of forces may be utilized to activate different portions of the setting and release process of the slip hanger assembly 30. In the illustrated engaged position, the slips 62 dig into the tubular 22 via the teeth 68.

Figure 9:
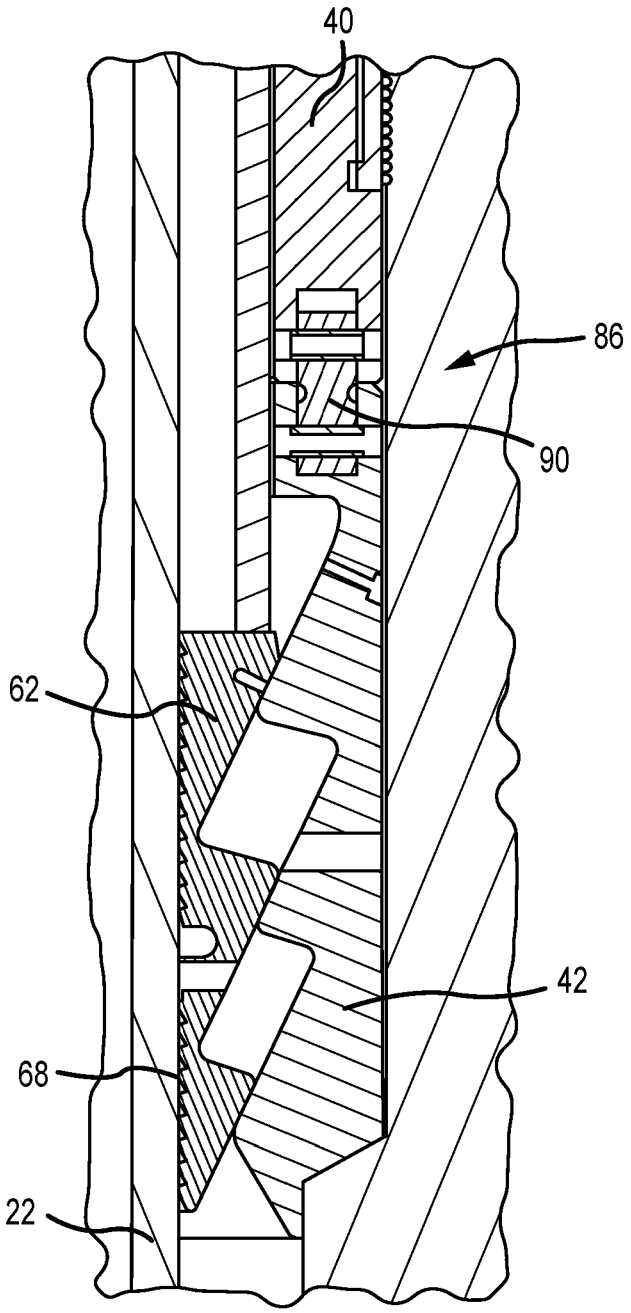
FIG. 9 is a detailed cross-sectional view of an embodiment of a slip of the slip hanger assembly of FIG. 1, in accordance with embodiments of the present disclosure.

FIG. 9 is a detailed cross-sectional view of an embodiment of the slip 62 in the engaged position. In the illustrated embodiment, the gap 110 in the coupling 86 is arranged to enable the block 90 to shear the pins 88 and facilitate removal of the housing 38 and the running tool 40 from the wellbore 16 upon activation of the piston 56, for example at a predetermined pressure. In various embodiments, the force of the piston 56 may be different in terms of shearing the pins 88 and the shear pin 94. For example, the force to shear the pins 88 may be greater than the force to shear the shear pin 94. Accordingly, the slips 62 may be set before shearing the pins 88, thereby providing options to the operator to either leave the slip hanger assembly 30 within the wellbore 16 or conduct other operations prior to removing the slip hanger assembly 30.

Engaging the slips 62 eliminates the gap between the slip 62 and the tubular 22 shown in FIG. 4. The teeth 68 on the rear end of the slip 62 dig into the tubular 22 to form a secure fitting. In the illustrated embodiment, the slip bowl 42 does not move with the slip 62. The friction between the tubular 22 and the teeth 68 of the slip 62 maintain a position of the slip 62 even after the running tool 40 is removed, thereby enabling further wellbore operations. Moreover, because the housing 38 and running tool 40 may be removed while the slip bowl 42 and slip 62 remain downhole, the housing 38 and running tool 40 may be reused in different downhole operations.

Figure 10:
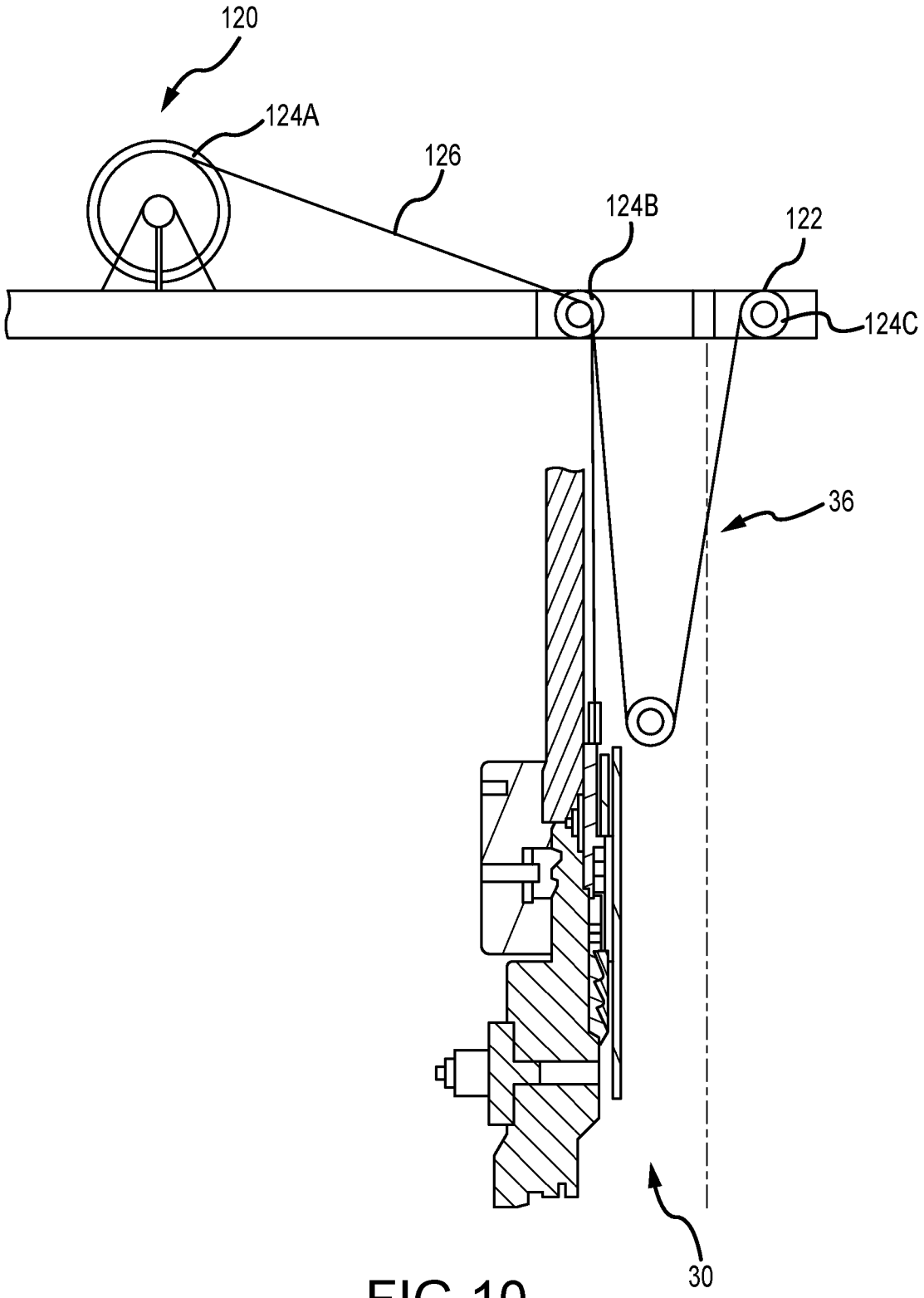
FIG. 10 is a schematic view of an embodiment of a winch and skid, in accordance with embodiments of the present disclosure.

FIG. 10 is a schematic elevational view of an embodiment of a winch 120 arranged on a skid 122 for installing the slip hanger assembly 30 within the wellbore 16. It should be appreciated that, for clarity, features have been removed from FIG. 10. For example, the wellhead assembly and associated components, such as the BOP, are not illustrated. However, as described above, in various embodiments the components of the slip hanger assembly 30 are particularly selected to facilitate installation through the BOP so as to reduce the amount of equipment removed or modified at the surface.

The illustrated embodiment includes a plurality of pulleys 124 which may be utilized in combination with a cable or rope 126 for installation and removal of the slip hanger assembly 30. In the illustrated embodiment, a first pulley 124A is arranged farther from the wellbore 16 than a second pulley 124B and a third pulley 124C. Furthermore, the first pulley 124A is larger than the second and third pulleys 124B, 124C. It should be appreciated that the location, number, and size of the pulleys 124 may be particularly selected based on the operational parameters at the well site.

The cable 126 is threaded around the pulleys 124 and coupled to the slip hanger assembly 30 to enable installation and removal of the slid hanger assembly 30 from the wellhead 16. It should be appreciated that the winch 120 may not be mounted on the skid 122. For example, individual pulleys 124 may be positioned at the wellhead based on the operating conditions at the wellhead. Moreover, in certain embodiments, the winch 120 may include various instrumentation systems, motors, controllers, and the like to control installation and removal of the slip hanger assembly 30. For example, the motor and instrumentation systems may monitor a descent rate of the slip hanger assembly 30 and the controller may be utilized to send instructions to the motor to increase or decrease the rate.

Embodiments of the present disclosure may be assembled at an off-site shop or at the well site. That is, the slips 62 may be positioned within the slip bowl 42 and coupled to the running tool 40 and housing 38 at a variety of locations, thereby increasing the flexibility and usability of the slip hanger assembly 30. Furthermore, in various embodiments, different components may be assembled at different locations. For example, the slip bowl 42 may be assembled to include the slips 62 at an off-site location and be shipped to the well site. At the wellsite, the slip bowl 42 may be coupled to the running tool 40 if needed. Accordingly, shipping may be easier since smaller, lighter components may be transported and stored at the well site and used when needed.

Figure 11:
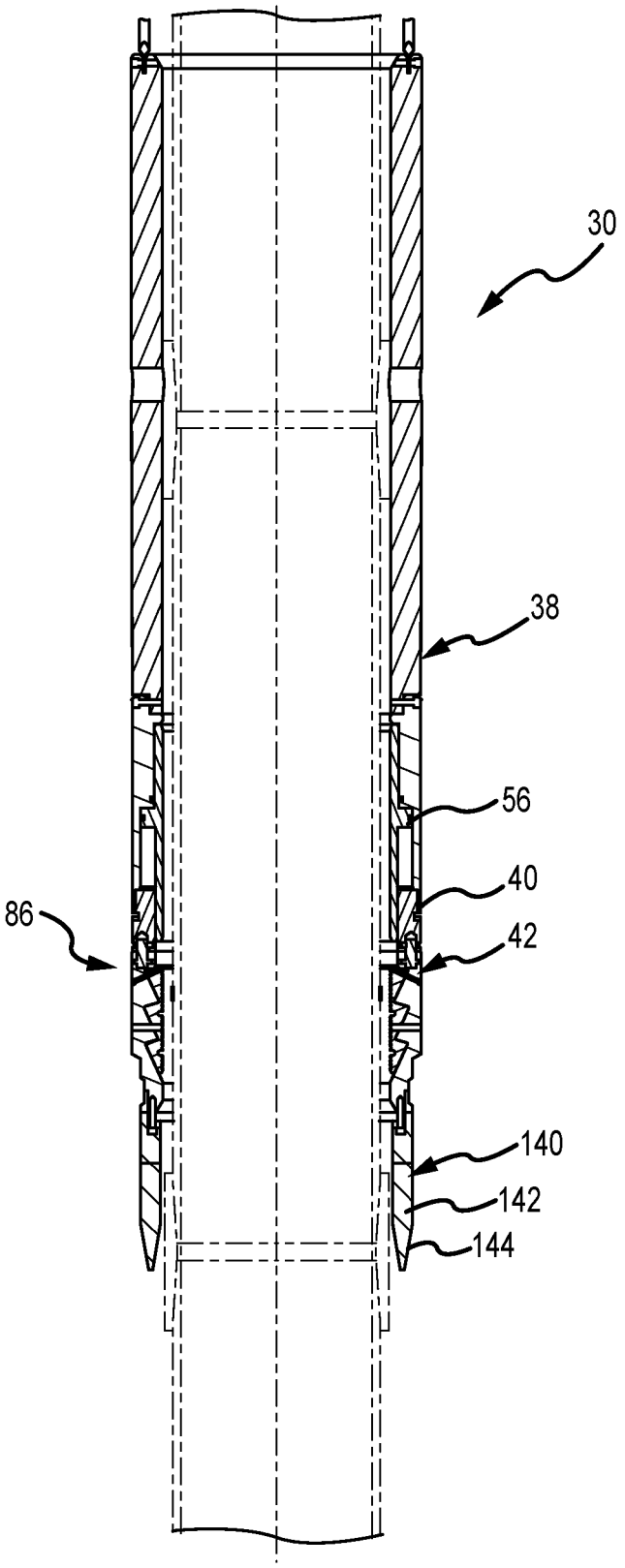
FIG. 11 is a schematic cross-sectional view of an embodiment of a slip hanger assembly, in accordance with embodiments of the present disclosure.

FIG. 11 is a cross-sectional view of an embodiment of the slip hanger assembly 30 in which the piston 56 is arranged at a higher vertical position relative to the running tool 40. As a result, a bottom portion of the piston 56 (e.g., a portion which contacts the slips 62 to drive movement of the slips 62) is not aligned with the pins 88 and/or the coupling 86, in the illustrated embodiment. Accordingly, the pins 88 are readily accessible without dismantling the tool. In other words, the position of the piston 56 does not interfere with providing access to the pins 88 in the illustrated embodiment.

The embodiment illustrated in FIG. 11 further differs from the embodiment illustrated in FIG. 2 in that a length of the housing 38 is increased. As described above, the longer housing 38 increases the weight of the tool to assist with driving the tool into position, for example, by maintaining tightness in the cable 126 as the slip hanger assembly 30 is installed within the wellbore 16.

Further illustrated in FIG. 11 are guides 140 coupled to the slip bowl 42. In various embodiments, the guides 140 may be referred to as centralizers. The illustrated guides 140 include an elongated body 142 that extends downwardly and has a tapered end 144. In various embodiments, the tapered end 144 may be substantially symmetrical, as illustrated in FIG. 11, or in other embodiments the tapered end 144 may not be symmetrical. The tapered end 144 may facilitate alignment with the collar 24 and/or the segment 22. For example, if the slip hanger assembly 30 where not substantially aligned with the collar 24, the tapered end 144 may contact the collar 24 and drive the slip hanger assembly 30 into alignment with the collar 24. Furthermore, in certain embodiments, the wellbore 16 and/or casing of the wellbore 16 may be offset or include variances regarding diameter. The guides 140 enable the slip hanger assembly 30 to pass through regions having the variances to assist with engagement of the tubular.

Figure 12:
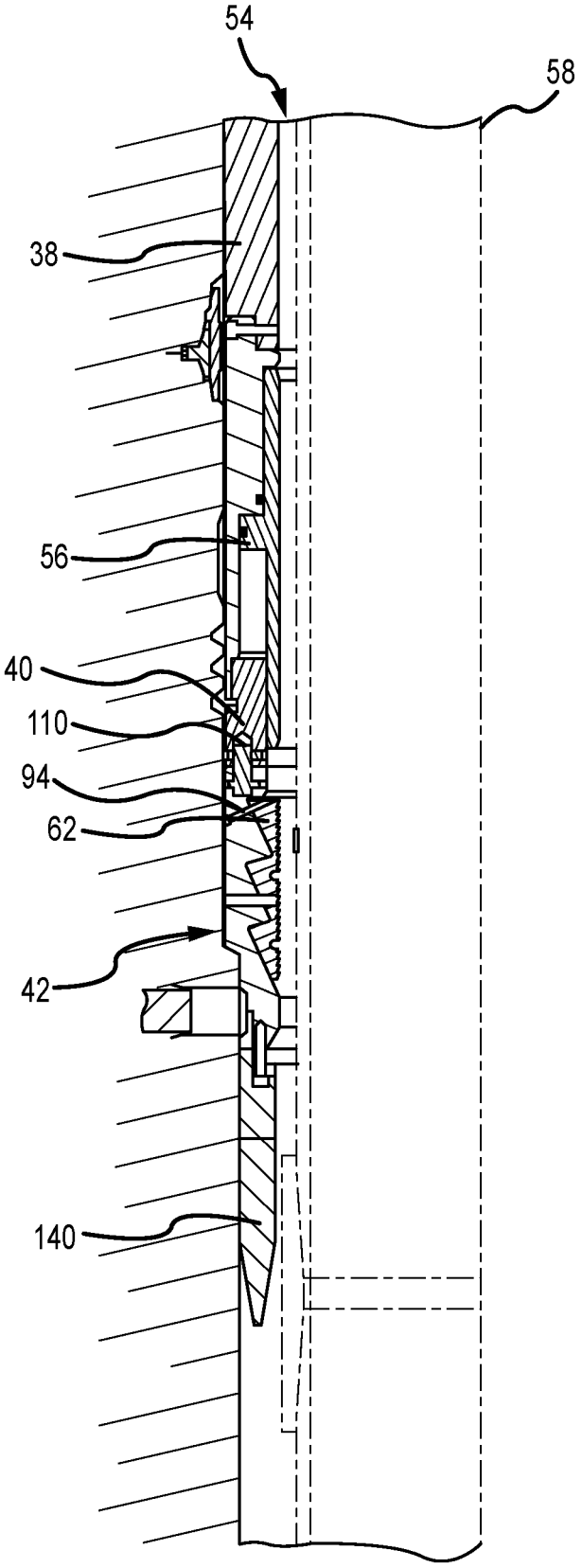
FIG. 12 is a detailed cross-sectional view of the slip hanger assembly of FIG. 10, in accordance with embodiments of the present disclosure.
Figure 13:
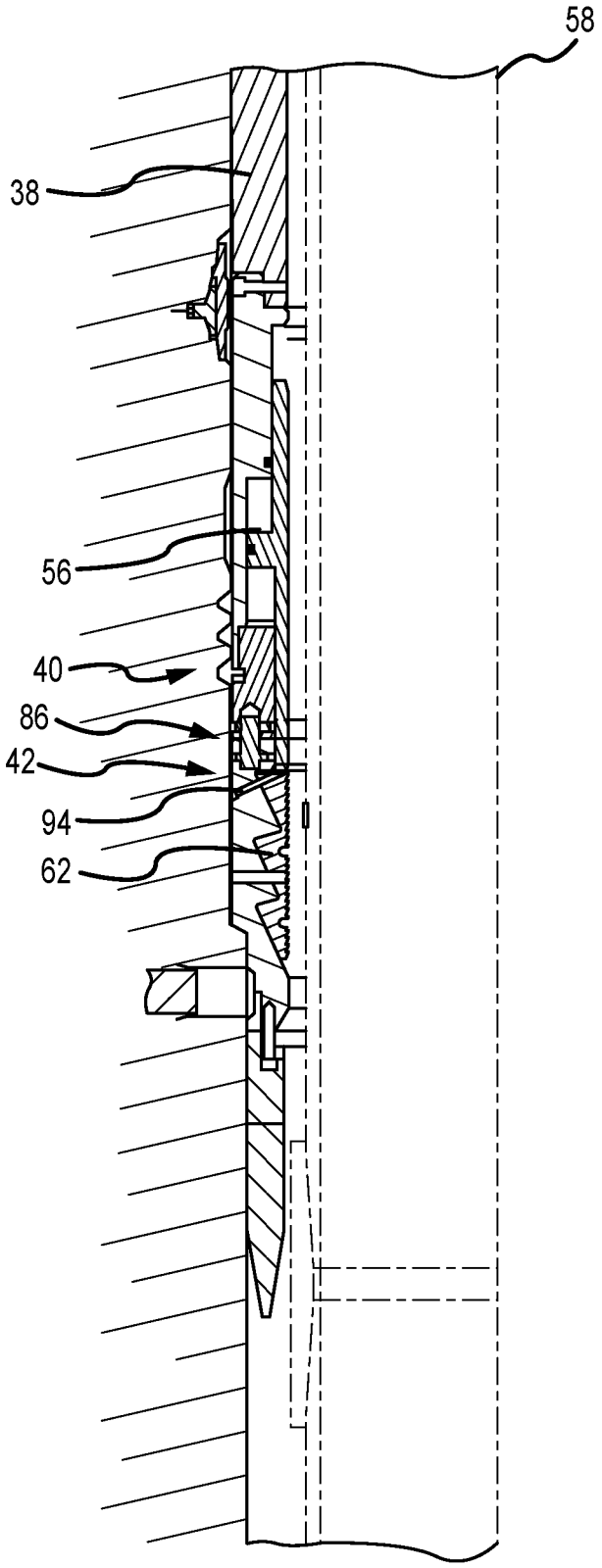
FIG. 13 is a detailed cross-sectional view of the slip hanger assembly of FIG. 10, in accordance with embodiments of the present disclosure.

FIGS. 12-17 are cross-sectional views of the slips 62 transferring from the stored position to an engaged position via a force applied by the piston 56. FIG. 12 illustrates the slips 62 stored within the slip bowl 42 and retained via the shear pin 94. The illustrated shear pin 94 is arranged at the angle 100, however it should be appreciated that the shear pin 94 may be in different orientations in other embodiments. As shown, the gap 110 is arranged within the coupling 86, which will be closed as the piston 56 moves in the downward direction to drive the slips 62 toward the engaged position. In the embodiment illustrated in FIG. 12, the piston 56 is arranged at the top of the cylinder 80. That is, the extension 82 is arranged such that the piston 56 is at a top of its stroke. FIG. 13 illustrates the beginning of the transition from the stored position to the engaged position, for example via the introduction of fluid into the cylinder 80 via one or more ports 54. As shown, the extension 82 of the piston 56 has moved in the downward direction. The movement has not closed the gap 110, in the illustrated embodiment, but has transitioned the bottom 96 of the piston 56 into contact with the slips 62.

Figure 14:
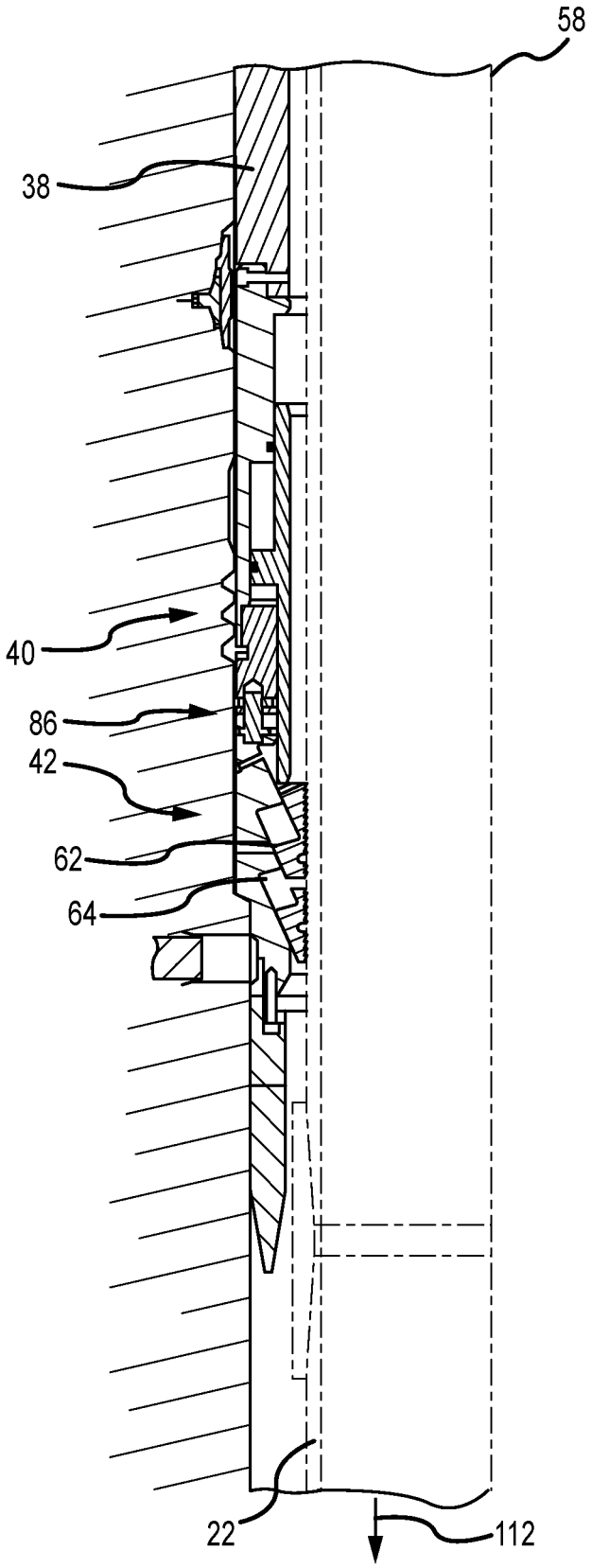
FIG. 14 is a detailed cross-sectional view of the slip hanger assembly of FIG. 10, in accordance with embodiments of the present disclosure.
Figure 15:
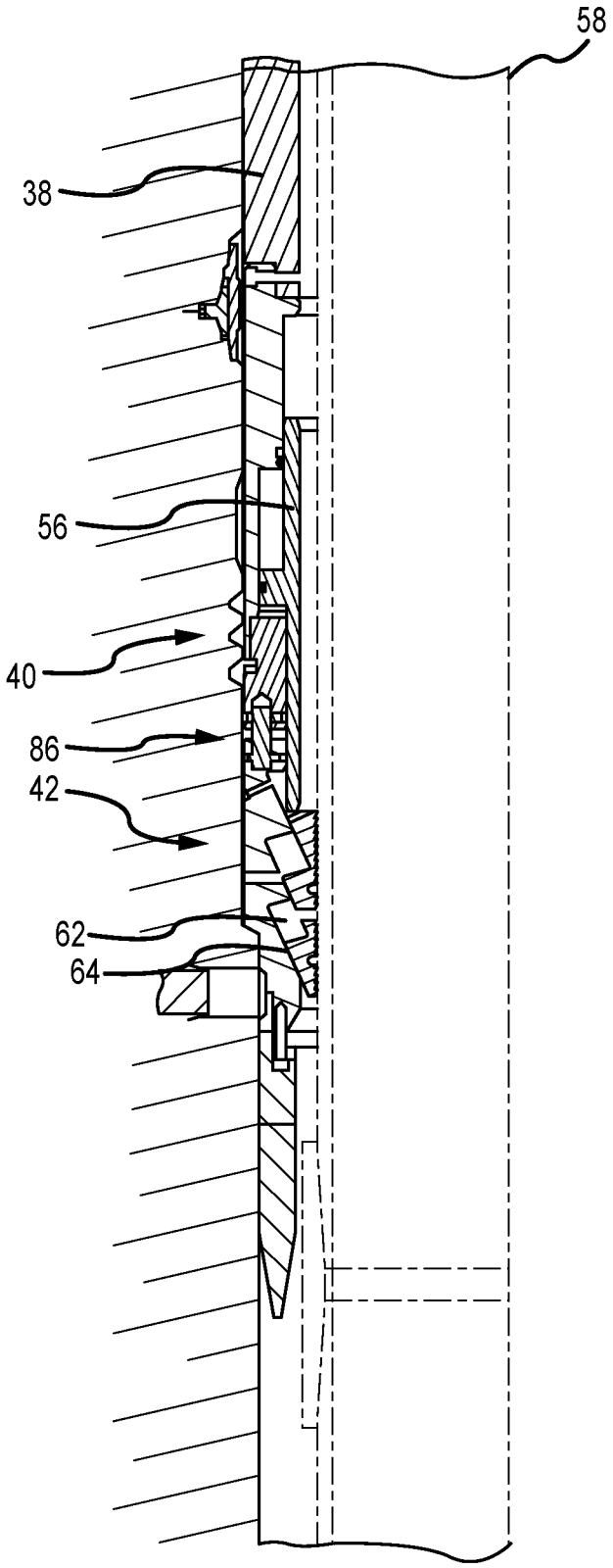
FIG. 15 is a detailed cross-sectional view of the slip hanger assembly of FIG. 10, in accordance with embodiments of the present disclosure.
Figure 16:
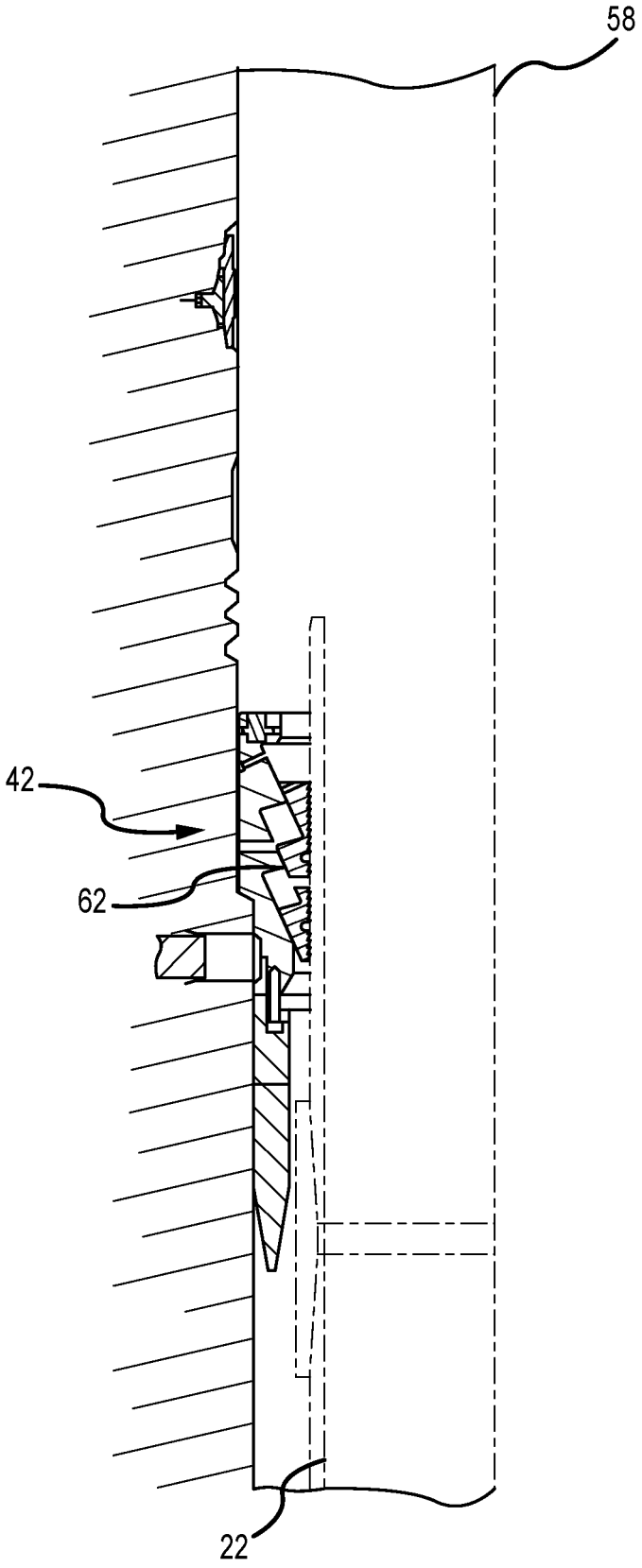
FIG. 16 is a detailed cross-sectional view of the slip hanger assembly of FIG. 10, in accordance with embodiments of the present disclosure.
Figure 17:
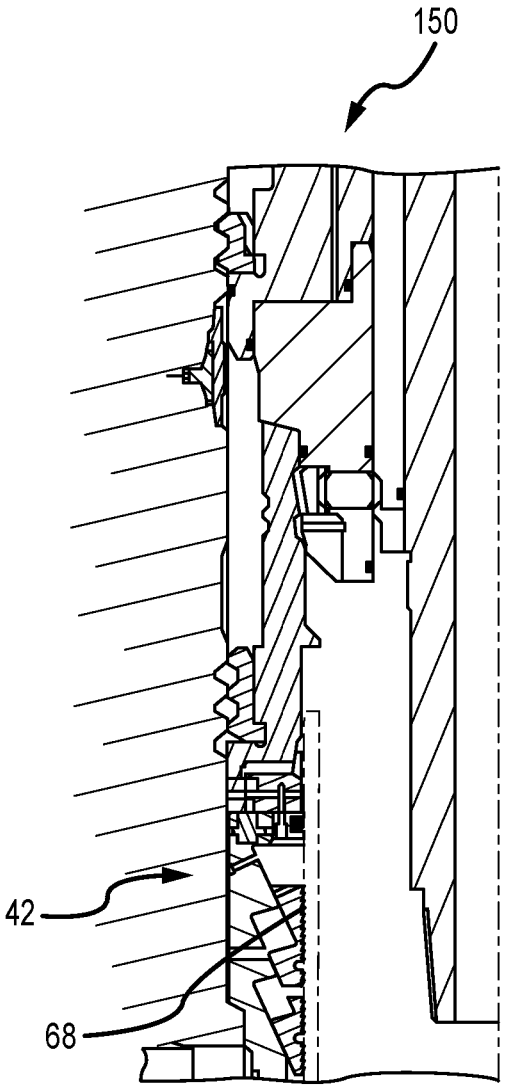
FIG. 17 is a detailed cross-sectional view of the slip hanger assembly of FIG. 10 and a dummy hanger, in accordance with embodiments of the present disclosure.

Continuing to FIG. 14, further movement of the piston 56 in the downward direction 112 is illustrated as the extension 82 travels through the cylinder 80. The slips 62 illustrated in FIG. 14 have disengaged the profile 64 of the slip bowl 42 and being to transition in the downward direction due to the force of the piston 56. As shown, the shear pin 94 has broken to enable movement of the slips 62. As the slips 62 move in the downward direction, they also move inwardly such that the teeth 68 engage the segment 22. Turning to FIG. 15, as the piston 56 continues to move in the downward direction, the gap 110 is eliminated due to movement of the running tool 40. As a result, the block 90 of the coupling 86 bears against the pins 88, which breaks the pins 88 to decouple the running tool 40 from the slip bowl 42. As illustrated, such movement of the piston 56 continues to drive the slips 62 against the segment 22. FIG. 16 illustrates the slip bowl 42 coupled to the tubular 22 via the slips 62 with the running tool 40 and the housing 38 removed, for example via the conveyance system 36. The tubular 22, in the illustrated embodiment, is cut to enable attachment of other wellbore equipment, such as, for example, dummy hangers and the like. FIG. 17 illustrates a dummy hanger 150 that is landed on the slip hanger assembly 30. As a result, further wellbore operations may commence. In the illustrated embodiment, at least a portion of the weight of the dummy hanger 150 is supported by the slip bowl 42.

Embodiments of the present disclosure may be utilized with a variety of drilling and/or production systems. For example, in embodiments where a top drive is utilized to drill a well, the top drive may be removed from a casing while the tubular 22 is held with slips or tongs. The slip hanger assembly 30 may then be positioned over the casing. Subsequently, the casing is held using the top drive. Next, the cable may be threaded through the various pulleys 124 of the winch 120 and the slip hanger assembly 30. Then, the tool may be lowered into the wellhead using the cable. For example, the winch 120 may include a controller on one or more of the pulleys 124 to control the rate of descent of the slip hanger assembly 30.

In various embodiments, the slip hanger assembly 30 may be installed within the wellbore 16 and then the piston 56 may be activated in order to set the slips 62. It should be appreciated that, in various embodiments, different loads may be applied in order to perform different actions in the wellbore 16. In various embodiments, a location to position the slip hanger assembly 30 is tagged and a neutral load is positioned on the conveyance system 36 when the slip hanger assembly 30 is landed on a load shoulder. Next, the slip hanger assembly 30 is activated. For example, the piston may apply approximately 250 pounds per square inch (e.g., approximately 10,600 pounds) to shear the shear pins 94 holding the slips 62. Thereafter, the slips 62 travel a distance, for example, approximately 1.35 inches to make up with an outer diameter of the segment 22 (which, as described above, may be production tubing, a casing, or the like). Then, the pressure is increased to approximately 500 pounds per square inch (e.g., approximately 20,600 pounds) to ensure a positive bite is made up with the teeth 68 of the slip 62. Additionally, the segment 22 may be partially released to test the bite between the teeth 68 and the segment 22. Subsequently, the pressure may be further increased to approximately 1225 pounds per square inch (e.g., 51,900 pounds) to shear the pins 88 between the running tool 40 and the slip bowl 42. Then, the running tool 40 may be retrieved from the wellbore 16 via the cable 126 and the winch 120. Subsequent operations in the wellhead 16 may be performed after the slips 62 are set. For example, in certain embodiments, the slip supported casing may be cut to a specific elevation to leave the landing surface for a dummy hanger assembly, an internal seal, and an external seal.

Figure 18:
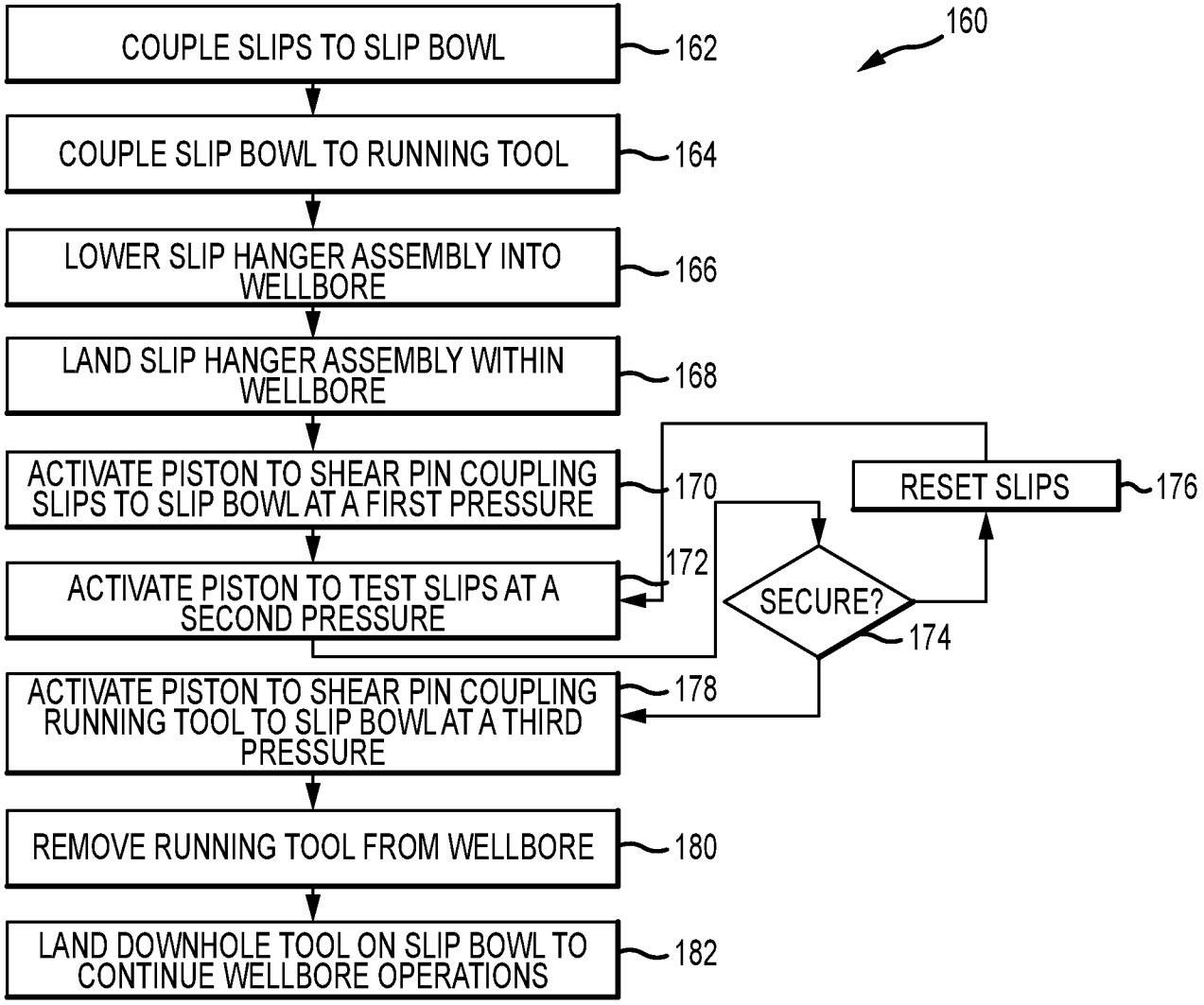
FIG. 18 is a flow chart of an embodiment of a method for installing a slip hanger assembly, in accordance with embodiments of the present disclosure.

FIG. 18 is a flow chart of an embodiment of a method 160. It should be appreciated that for methods described herein that the steps may be performed in any order, or in parallel, unless otherwise stated. Moreover, there may be more or fewer steps. In various embodiments, the slips 62 are coupled to the slip bowl 42 (block 162). As noted above, the slips 62 may be coupled to the slip bowl 42 at the well site or prior to delivery to the well site. The method also includes coupling the slip bowl 42 to the running tool 40 (block 164). For example, in various embodiments the coupling 86 is utilized such that the block 90 extends between the slip bowl 42 and the running tool 40 and includes pins 88 within openings 92. The slip hanger assembly 30 is lowered into the wellbore 16 (block 166), for example via cables 126 coupled to the winch 120. In various embodiments, the slip hanger assembly 30 is landed within the wellbore 16, for example on a load shoulder or other structure within the wellbore 16 (block 168).

Once the slip hanger assembly 30 is positioned within the wellbore 16, the piston 56 may be activated to shear the shear pin 94 coupling the slips 62 to the slip bowl 42 (block 170). In certain embodiments, the shear pin 94 is particularly selected such that a first pressure is utilized to shear the shear pin 94, but does not shear other pins of the assembly 30, such as the pins 88. Shearing the shear pin 94 releases the slips 62, which may be driven downwardly and inwardly to grip the tubular 22 via teeth 68. The slips 62 may be tested at a second pressure (block 172). For example, the pressure acting on the piston 62 may be increased to further set the slips 62 and to determine whether the slips 62 have set. Furthermore, in various embodiments, the segment 22 may be partially released to test the bite between the teeth 68 and the segment 22. The bite of the teeth 68 may be evaluated (block 174) to determine whether the bite is secure. If not, the slips 62 may be reset (block 176). If the slips 62 are secure, the piston 56 may be activated at a third pressure to shear the pins 88 coupling the running tool 40 to the slip bowl 42. When the pins 88 are sheared, the running tool 40 may be removed from the wellbore (block 178) while the slip bowl 42 remains coupled to the tubular 22. Thereafter, additional downhole tools may be landed on the slip bowl 42 (block 180) to continue wellbore operations.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A system for installing a slip hanger assembly in a wellbore, the system comprising:

a slip bowl comprising a stepped inner profile and an aperture extending from an outer diameter of the slip bowl to the stepped inner profile;

a slip coupled to the slip bowl, the slip having a mating external profile and being arranged against the stepped inner profile, the slip further comprising teeth on an inner face and a slot for receiving a shear pin extending through the aperture;

a running tool coupled to the slip bowl;

a housing coupled to the running tool, the housing including a cylinder for receiving a reciprocating piston, the piston being movable between a first position and a second position, wherein the slip is in stored position while the piston is in the first position and an engaged position when the piston is in the second position; and a coupling joining the running tool to the slip bowl, the coupling including a block extending between the running tool and the slip bowl, the block moving in response to movement of the piston to decouple the slip bowl from the running tool.

2. The system of claim 1, wherein the coupling further comprises:

a slot formed at least partially in the running tool and at least partially in the slip bowl;

the block positioned within the slot, the block having at least one opening for receiving a shear pin extending through a coupling aperture formed in at least one of the running tool or the slip bowl; and a gap formed in the slot comprising a void space, the gap being removed when the block is driven, via the piston, to shear the at least one shear pin and decouple the running tool from the slip bowl.

3. The system of claim 1, further comprising:

a conveyance system coupled to the housing, the conveyance system tripping the slip hanger assembly in and out of the wellbore; and a surface winch having a cable coupled to the conveyance system, wherein the surface winch regulates a descent and an ascent of the slip hanger assembly.

4. The system of claim 3, wherein the conveyance system comprises at least one pulley.

5. The system of claim 1, further comprising:

a downhole tubular having a collar arranged at an end thereof, the collar having a larger diameter than the downhole tubular;

wherein the slip hanger assembly is arranged around the collar and the teeth of the slip bite into the downhole tubular when the slip is transitioned to the engaged position.

6. The system of claim 5, wherein the downhole tubular forms at least a portion of one of a production string or a casing string.

7. The system of claim 1, further comprising:

a dummy hanger seated on the slip bowl, the dummy hanger being deployed into the wellbore after the slip is in the engaged position.

8. A system for installing a downhole tool onto a wellbore tubular, the system comprising:

a winch arranged at a surface location, the winch including a cable controllable via movement of the winch;

a blow out preventer coupled to a wellbore; and a slip hanger assembly, the slip hanger assembly being coupled to the winch via the cable and installed through the blow out preventer, the slip hanger assembly comprising:

a housing, the housing having a cylinder that contains a piston;

a running tool coupled to the housing; and a slip bowl coupled to the running tool via a releasable coupling, wherein activation of the piston at a first predetermined force releases the running tool from the slip bowl, the releasable coupling including a block extending between the running tool and the slip bowl, the block moving in response to movement of the piston to decouple the slip bowl from the running tool; and a plurality of slips arranged within and releasably coupled to the slip bowl, wherein activation of the piston at a second predetermined force releases the plurality of slips from the slip bowl to engage the wellbore tubular at an outer diameter of the wellbore tubular.

9. The system of claim 8, wherein the first predetermined force is greater than the second predetermined force.

10. The system of claim 8, wherein the slip bowl further comprises a plurality of apertures substantially aligned with the plurality of slips, the plurality of apertures receiving respective shear pins that releasably couple the plurality of slips to the slip bowl.

11. The system of claim 8, further comprising a snap ring engaging the plurality of slips, wherein the snap ring drives movement of the plurality of slips at a substantially even rate to engage the outer diameter of the wellbore tubular at approximately the same time.

12. The system of claim 8, wherein each slip of the plurality of slips comprises teeth on an inner face, the teeth biting into the outer diameter of the wellbore tubular when the plurality of slips are released from the slip bowl.

13. The system of claim 8, wherein the releasable coupling further comprises:

a chamber formed at least partially in the running tool and at least partially in the slip bowl; and the block arranged in the chamber, the block comprising a first opening aligned with the running tool and a second opening aligned with the slip bowl, the first and second openings receiving respective pins;

wherein activation of the piston at the first predetermined force drives the block against the respective pins to shear the pins and release the running tool from the slip bowl.

14. The system of claim 8, further comprising a conveyance system coupled to the slip hanger assembly, the conveyance system comprising a plurality of pulleys that receive the cable of the winch.

15. The system of claim 8, further comprising a dummy hanger, the dummy hanger being landed onto the slip bowl after the piston is activated at the first and second predetermined forces and after the housing and running tool are removed from the wellbore through the blow out preventer.

16. A method for installing a downhole tool into a wellbore, the method comprising:

releasably coupling slips to a slip bowl, the slip bowl being arranged on a slip hanger assembly including a piston arrangement for releasing the slips from the slip bowl at a first predetermined force and for releasing the slip bowl, coupled to a running tool via a coupling, from the slip hanger assembly at a second predetermined force;

coupling the slip hanger assembly to a surface conveyance system, the surface conveyance system controlling a descent rate of the slip hanger assembly into the wellbore;

positioning the slip hanger assembly into the wellbore through a blow out preventer arranged at a surface location;

landing the slip hanger assembly onto a wellbore tubular;

activating the piston arrangement at the first predetermined force to release the slip from the slip bowl, the slip biting into an outer diameter of the wellbore tubular via teeth;

activating the piston arrangement at the second predetermined force to release the slip bowl from the slip hanger assembly, wherein the piston drives movement of a block positioned between the slip bowl and the running tool; and removing the slip hanger assembly from the wellbore while the slip bowl remains coupled to the wellbore tubular via the slips.

17. The method of claim 16, further comprising:

deploying a downhole tool into the wellbore, the downhole tool being installed through the blow out preventer; and landing the downhole tool on the slip bowl.

18. The method of claim 16, further comprising:

testing a connection between the slips and the wellbore tubular; and resetting the slips when the connection is below a predetermined threshold.

19. The method of claim 16, further comprising:

releasably coupling a plurality of slips to the slip bowl;

arranging a snap ring to couple the plurality of slips together; and deploying each slip of the plurality of slips substantially simultaneously, via the snap ring, upon activation of the piston at the first predetermined force.

20. The method of claim 16, further comprising:

controlling an ascent rate of the slip bowl assembly via a winch; and removing the slip hanger assembly through the blow out preventer.

* * * * *